US008104669B2

(12) United States Patent
Christensen et al.

(10) Patent No.: US 8,104,669 B2
(45) Date of Patent: Jan. 31, 2012

(54) STRENGTHENED FOLDER WITH INSERTED ELEMENTS AND SYSTEM FOR ELEMENT INTERCHANGEABILITY

(75) Inventors: Duane Christensen, Hastings, MN (US); Michael Lasky, Atlanta, GA (US)

(73) Assignee: Smead Manufacturing Company, Hastings, MN (US)

( * ) Notice: Subject to any disclaimer, the term of this patent is extended or adjusted under 35 U.S.C. 154(b) by 1016 days.

(21) Appl. No.: 12/034,403

(22) Filed: Feb. 20, 2008

(65) Prior Publication Data

US 2008/0197175 A1 Aug. 21, 2008

(51) Int. Cl.
*B65D 27/00* (2006.01)
*B42D 1/00* (2006.01)
*B42F 13/00* (2006.01)

(52) U.S. Cl. ..... 229/67.1; 229/67.3; 281/21.1; 281/23; 402/79

(58) Field of Classification Search ..... 229/67.1–67.4, 229/72; 281/21.1, 23; 402/73–77, 79
See application file for complete search history.

(56) References Cited

U.S. PATENT DOCUMENTS

| | | | | | |
|---|---|---|---|---|---|
| 282,275 | A | * | 7/1883 | Cooke, Jr. | 206/425 |
| 510,350 | A | * | 12/1893 | Lochmann | 206/425 |
| 1,698,841 | A | * | 1/1929 | Doughty | 229/72 |
| 3,008,248 | A | * | 11/1961 | Steinthal | 206/472 |
| 5,236,226 | A | | 8/1993 | Sheffield | |

* cited by examiner

*Primary Examiner* — Jes F Pascua
(74) *Attorney, Agent, or Firm* — Altera Law Group, LLC

(57) ABSTRACT

A folder system with an accordion spine 16, and a method of making same is disclosed. The folder may have a plurality of insert elements 52, 60 either at manufacture or by a stub system which are bound into the spine at the valleys 32 of the web which forms the spine. The web is made of outer zig-zag web 40, with the inner web 42, 44, 46 joining adjacent insert elements and the outer web, to create a strong spine of web and inserts.

10 Claims, 4 Drawing Sheets

STRENGTHENED FOLDER WITH INSERTED ELEMENTS AND SYSTEM FOR ELEMENT INTERCHANGEABILITY

CROSS REFERENCE TO RELATED APPLICATION

None

FIELD OF THE INVENTION

The present invention is directed to a folder system and method of making folders with partitions.

BACKGROUND

File folders, hanging file folders and other paper storage systems are of great utility in an office setting. The most common storage system, the common manila folder, for example are widespread and relatively inexpensive, and have convenient tabs suitable for writing. An example is shown in U.S. Pat. No. 5,236,226. Such folders may be available in hanging or non-hanging versions.

Typical folders have two sidewalls joined at a common edge. If additional storage capability is desired, users often switch to binders such as 2 or 3 ring binders, but this system is not compact (the rings themselves determine their minimum dimension).

There is a need to create a folder system which is capable of having multiple dividers with attachment or storage devices. Such a system needs to be flexible yet extremely strong.

BRIEF SUMMARY

Reference should be had to the claims for a complete understanding of the scope of the invention but for the readers convenience in preparing to read the full application, this summary is provided.

In this application there is disclosed a file folder, having a first panel having a common edge; a second panel having a common edge; a first web having a plurality of adjacent accordion peaks and valleys joining said panels proximate said common edge, to create a spine between said panels; at least one insert element having a common edge and two sides, said insert element being affixed at said common edge to said spine at least one of said valleys; a second flexible web extending from and affixed to said one side of said insert element and then to at least a portion of said first web along at least one valley wall, a third flexible web extending from and affixed to the other side of said insert element and then to at least a portion of said first web along at least one valley wall, whereby said insert element is securely bonded to said second web and the spine proximate the bottom of one of said valleys.

A further disclosure is made of a file folder including a second insert element located in another valley of said spine, and where said second web material is affixed at one end to the first insert element and at the other end at the second insert element, with the remainder of the web between said ends being affixed to the first web material.

A further disclosure is made of a user definable file folder arrangement, having a first panel having a common edge; a second panel having a common edge; a first flexible web material having a plurality of adjacent peaks and valleys joining said panels proximate said common edge, at least one insert stub element having a common end, said stub element be affixed at said common end to said web in at least one of said valleys, said stub element extending away from said valley part way into the spaced defined between said first and second panels and displaying an adhesion region; at least one insert element having an adhesion region sized to engage at least a portion of said adhesion region on said stub whereby a user may bond an insert element into said folder by attaching it to the stub and thereby create a folder with at least one user defined insert element.

A further disclosure is made of a second web extending from said first panel to one side of said stub element, and a third web extending from said second panel to the other side of said stub element and at least a portion of said first and second webs being in bonded contact with said first web.

A further disclosure is made of a plurality of stub members, and wherein said insert members include a plurality of insert member styles whereby the user may define a folder with different combinations of styles.

A further disclosure is made of adhesion region includes releasable and re-usable adhesive, so that the user may swap insert elements at will.

A further disclosure is made of insertion member styles including pockets and boards.

A further disclosure is made of insert styles selected from a group consisting of binders, folios, clip boards, pockets, A further disclosure is made of at least one insert element is a stub element of dimension smaller than said first or second panels.

A further disclosure is made of the extension member includes a plurality of user selectable elements from the group of at least planar elements, pocket elements.

A further disclosure is made of a method making a file folder to have a plurality of insert elements, providing first and second folder covers, corrugating first web of material so that it has a plurality of peaks and valleys and free ends; affixing said free ends of said first web to said first and second folder covers; placing at least one insert element into one of said valleys; applying a second web to at least a portion of sidewalls of said insert element at said valley; applying at least a portion said second web to said first web so that said insert element is bound to said valley by two webs which are in turn, bound to each other.

A further disclosure is made of a method further including the step of binding into said spine, a stub element and further including the step of supplying at least one extension element, and configuring said stub and extension element to be user affixable to each other.

A further disclosure is made of a method further including the step of providing a plurality of extension elements which are affixable to said stub element.

A further disclosure is made of a method further including the step of providing a plurality of extension elements of different function.

A further disclosure is made of a method making a file folder to have a plurality of user selectable insert elements, providing first and second folder covers, corrugating first web of material so that it has a plurality of peaks and valleys and free ends; affixing said free ends of said first web to said first and second folder covers; placing at least one stub element into one of said valleys; applying a second web to at least a portion of sidewalls of said stub element at said valley; applying at least a portion said second web to said first web so that said stub element is bound to said valley by two webs which are in turn, bound to each other, providing a plurality of extension elements to be user selectively attached to said at least one stub element.

The present invention has many facets and only a few are set forth in this summary. Reference should be had to the detailed description and the claims for a full definition of the invention.

DETAILED DESCRIPTION OF THE INVENTION

Figure 1:
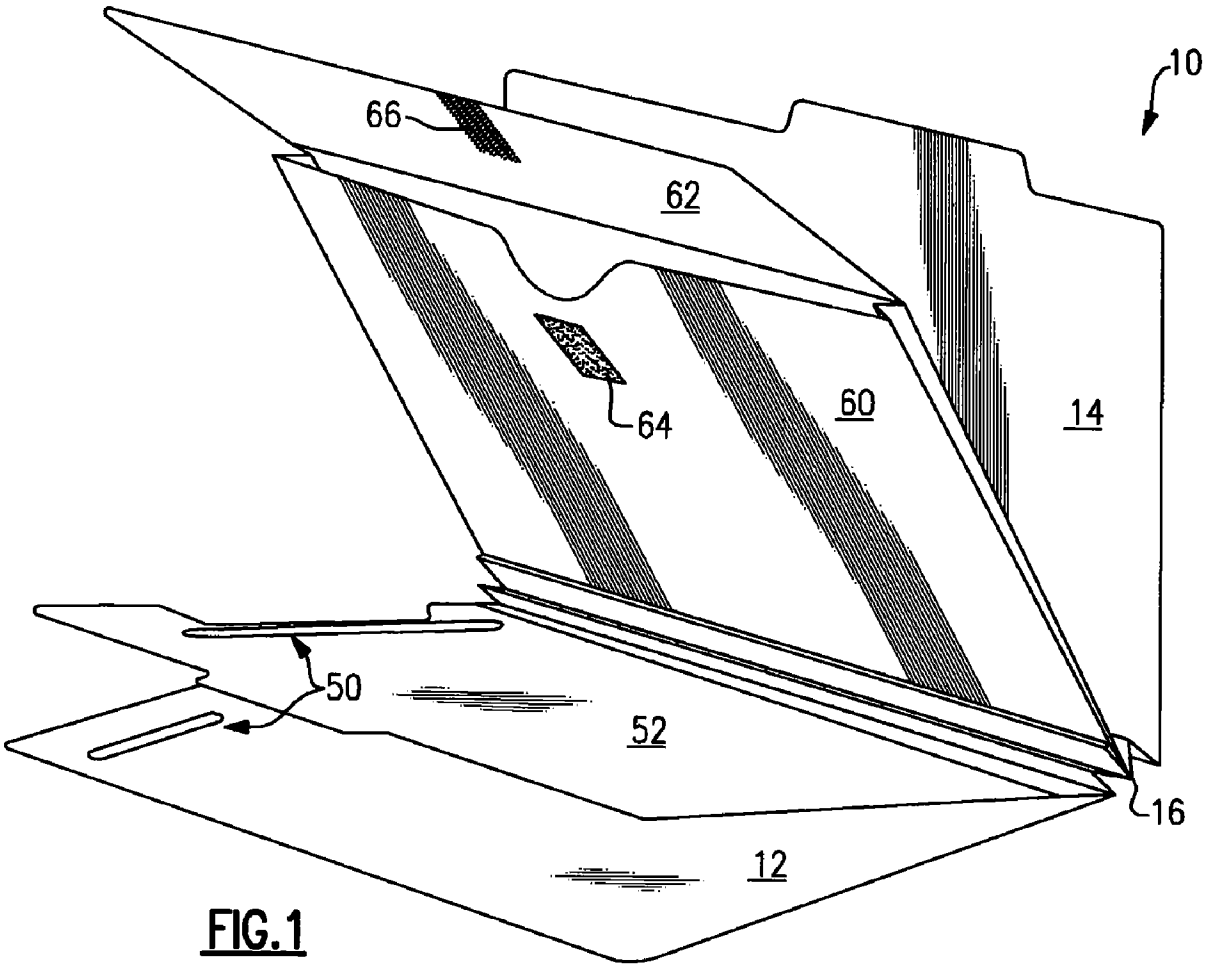
FIG. 1 is a perspective view of a folder according to one embodiment.

A folder system with an accordion spine, and a method of making same is disclosed. The folder may have a plurality of insert elements either at manufacture or by a stub system which are bound into the spine at the valleys (or alternatively, peaks) of the web which forms the spine. The web is made of outer zig-zag material, with the inner web joining adjacent insert elements and the outer web, to create a strong spine of web and inserts. The stub 82 may be a strip of material bound into the peak or valley (just like an insert element), except that it is of smaller dimension than such insert. In most cases it will be as long as any other insert, but it will extend away from the web just enough to provide a connection surface for a plurality of interchangeable extension elements The present invention is directed to a multiple partition folder and method of making same. The term folder is intended to encompass a range of other office requisites, such as binders, folios, clip pocket etc. i.e. Insertion elements which provide different function or utility to the folder, which may have the ability to be bound/joined with dividers therein.

For the sake of brevity, the embodiments in the figures will be discussed simultaneously and the same reference numerals will be used whenever the elements are the same or similar.

FIG. 1 illustrates a perspective view of a folder 10 according to the present invention.

Folder 10 has front substantially planar front panel 12 and a rear face 14, joined at the bottom/outer by web 16. The web is shown in greater detail in FIG. 2 and forms the spine to the folder.

The web is, generally speaking, a material formed into a series of zig-zag ("w" shaped) folds 18, 20. Such folds create peaks 30 and valleys 32 (as viewed from the inside).

Figure 2:
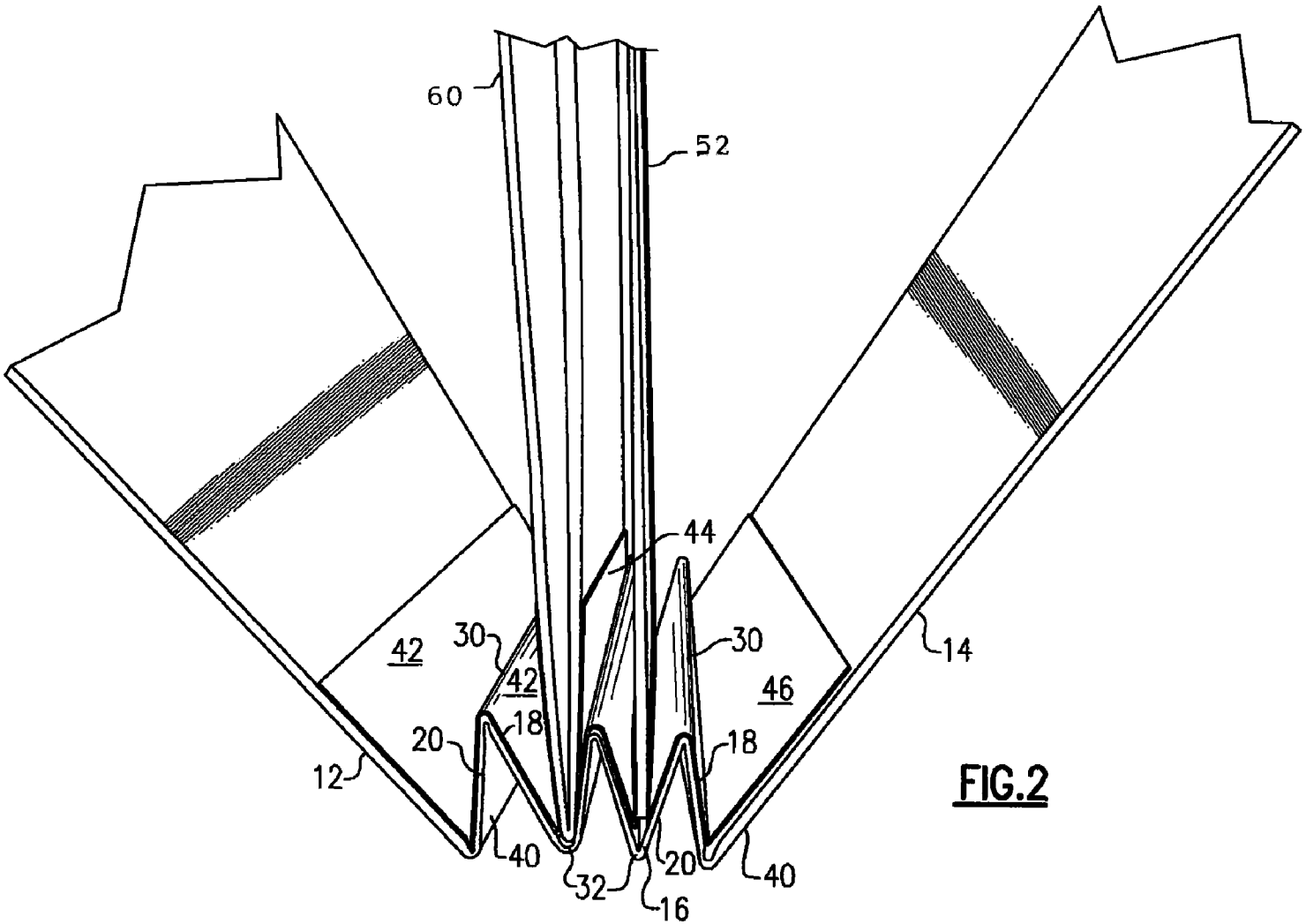
FIG. 2 is a partial perspective view taken from the side, with portions broken away.

Further detail of the spine web is shown in FIG. 2. Construction of the spine web is preferably made as follows. A first piece of preferably flexible reinforced material is attached to the outer panels 12 and 14 on their outer surfaces, usually by adhesive. The material 40 is corrugated into the zig-zag "w" pattern between the attachment portions which are affixed to the panels 12 and 14. Practically speaking it is preferable to corrugate the material 40 before affixing to the panels.

The interior webbing can be constructed in at least two way. The first is series of interior web portions 42, 44 and 46 are installed/bonded with web outer material 40. Then the additional divider options can be bonded into the valleys of the corrugated spine by applying an additional layer of flexible material 44 which overlays a portion of the insert element 52 (in this case a board for attachment of papers) as shown and then follows the spine zig-zag pattern and terminates adjacent the next insert or at the next peak or valley if there are no further inserts. The same would be done on the other wall of the insert 52 where a flexible material would be applied like 44 but on the opposite side wall.

The result is that insert elements 52 are strongly bonded to the spine by virtue of a web of material which overlies a portion of the insert elements side panels (on both sides) and then follows the zig-zag path of the spine either to the next insert element or merely terminates at the next adjacent peak, valley or somewhere in between.

The alternative method of construction is to dispense with the first interior layer of flexible material as proposed above, and use the flexible materials which attach the insert elements as the only interior material abutting the exterior zig-zag shaped spine material. This solution is less expensive and in most cases satisfactory.

Web material 42 is affixed, preferably adhesively, to panel 12, then directly on to the outer web 40 as it rises to peak 30 and then to valley 32. From there, this portion 42 of the web terminates as it is affixed the adjacent surfaces of portion of an insert element, here in the form of a divider 52. It is possible that this inner web material could be continuous and run over the entire divider 52 and proceed in to the next successive valley. This would produce an extremely strong web but it would also increase the cost of materials. The preferred web material is Tyvek® or other paper based but filamentary web material.

The remaining side of divider 52 is covered, preferably at its lower end, with a portion of web material (like 44 covering pocket 60), much like materials 42.

Material 44 spans the aforementioned lower surface of divider 52, along a peak 30 and valley 32 of web 40 and is preferably bonded thereto by adhesive to make a double web spine.

In this embodiment, the inserts (divider 52 and pocket 60) have been affixed to second web 40 with their bottoms at the valleys of the zig-zag pattern. This has several important benefits. First, it allows the largest possible inserts to be used. If for example the height peak to valley is 2 cm, then the insert element can be 2 cm taller if it is affixed in a valley rather than on a peak. Second, the bonding strength in a valley is greatly enhanced because there is more contact surface available for bonding. Third, when the folder is in a closed position, the insert elements are "crimped" between the zig-zag "w" pattern of the spine, thereby strengthening the connection with the spine. It can be seen in FIG. 2 that when the folder is in its folded position, the insert elements are trapped between the "W" folds of the spine and provide additional gripping force. If an insert element is heavy, this additional strength may be a critical advantage. Fourth, the location of insert elements in the valleys between portions of the spine, provides a spacer (formed of a peak of the spine) between successive insert elements.

As shown in FIGS. 1 and 2, panels 12 and 14 may include foldable clasps 50. In this embodiment, there is an additional insert elements, such as a panel 52 with a like clasp 50. Another insert element, shown adjacent panel 52, is a document wallet 60 is shown in this figure as an alternate to clasp divider 52.

This wallet 60 includes a pocket and a cover 62 which is removably affixed to the body of the wallet by hook and loop fastener pairs 64, 66. It is understood that many other types/styles of divider elements may be provide and inserted at time of manufacture, such as clip board, ring binder elements, electronic media holders, etc.

In addition to the increased attachment strength of the insert elements with respect to the spine, it is possible to take advantage of this construction to allow user selection of which insert elements can be assembled into a single binder. It should also be appreciated that instead of a complete insert element, a stub 82 (FIG. 4) system/element could be provided with a universal element attachment system to allow a user to insert a variety of user selectable/definable insert elements, alike or having different functionality (pockets, binders, clasps, etc) after manufacturer is complete. Many attachment systems could be used. For example, a plastic zipper attachment either with teeth or with mating grooves, such as in a Zip-Loc® bag, Velcro® hook and loop fasteners, adhesive with a peel off covering, and many other similar affixation systems may be used.

Instead of directly attaching an insert element into the spine, a stub 82, which is a short section attached to the spine as described above, but which only extends a short distance from the spine. The stub is preferably 2-5 cm beyond the point peak valley floor and may still be affixed to the spine by flexible material such as 44 shown in FIG. 2 and as described above. The difference is that over the flexible material 44 would be an affixation means or simply an area capable of receiving affixation means (in the case where the insert element has the affixation means instead of the stub or both).

Figure 4:
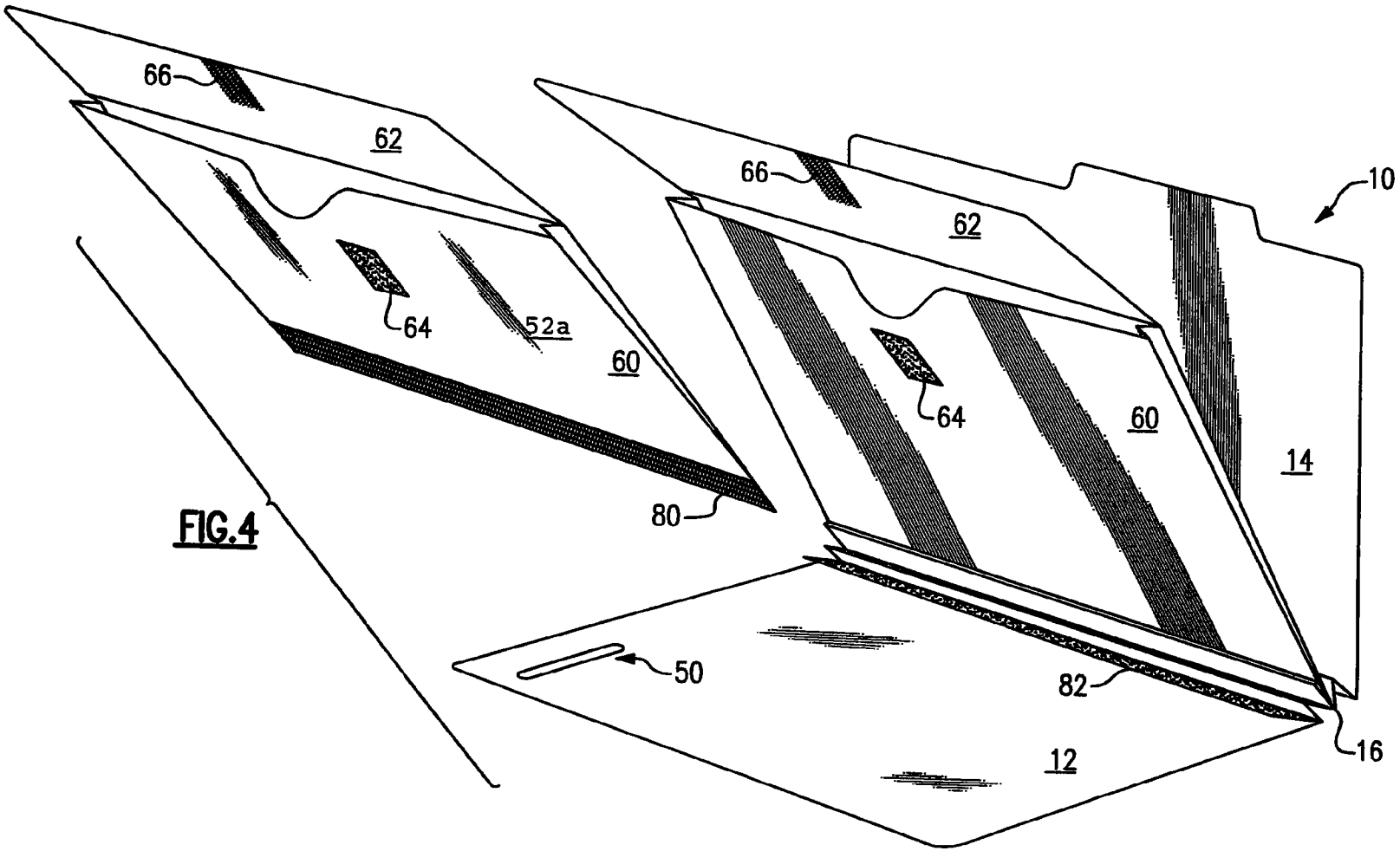

In FIG. 4 a pocket insert 52*a* is shown with an affixation portion 82 which mates with stub 82 which may likewise have an affixation portion. It will be appreciated that if affixation means is adhesive, normally only one of the two surfaces (80,82) require adhesive, but in case of Velcro® fasteners or contact cement or for extra adhesion, both surfaces may have a strip of adhesive material, perhaps covered by a removable protective strip as known in the art. We refer to adhesion region as a place on both the stub and insert element where the two can be bonded, whether the adhesion means in on one or both members. The region on the stub is any portion above the base of the valley, and on the insert element, it is typically the portion closest the distal end which will be located adjacent the valley.

Adhesive materials may also be applied to both sides of the stub and insert element if reversibility is required or desired. For example, if the insert is a pocket 60, then the direction of opening (of the flap 62) is controlled by to which side of the stub 82 it will be affixed. The stub may also be double sided for attachment of two insert elements back to back.

Figure 3:
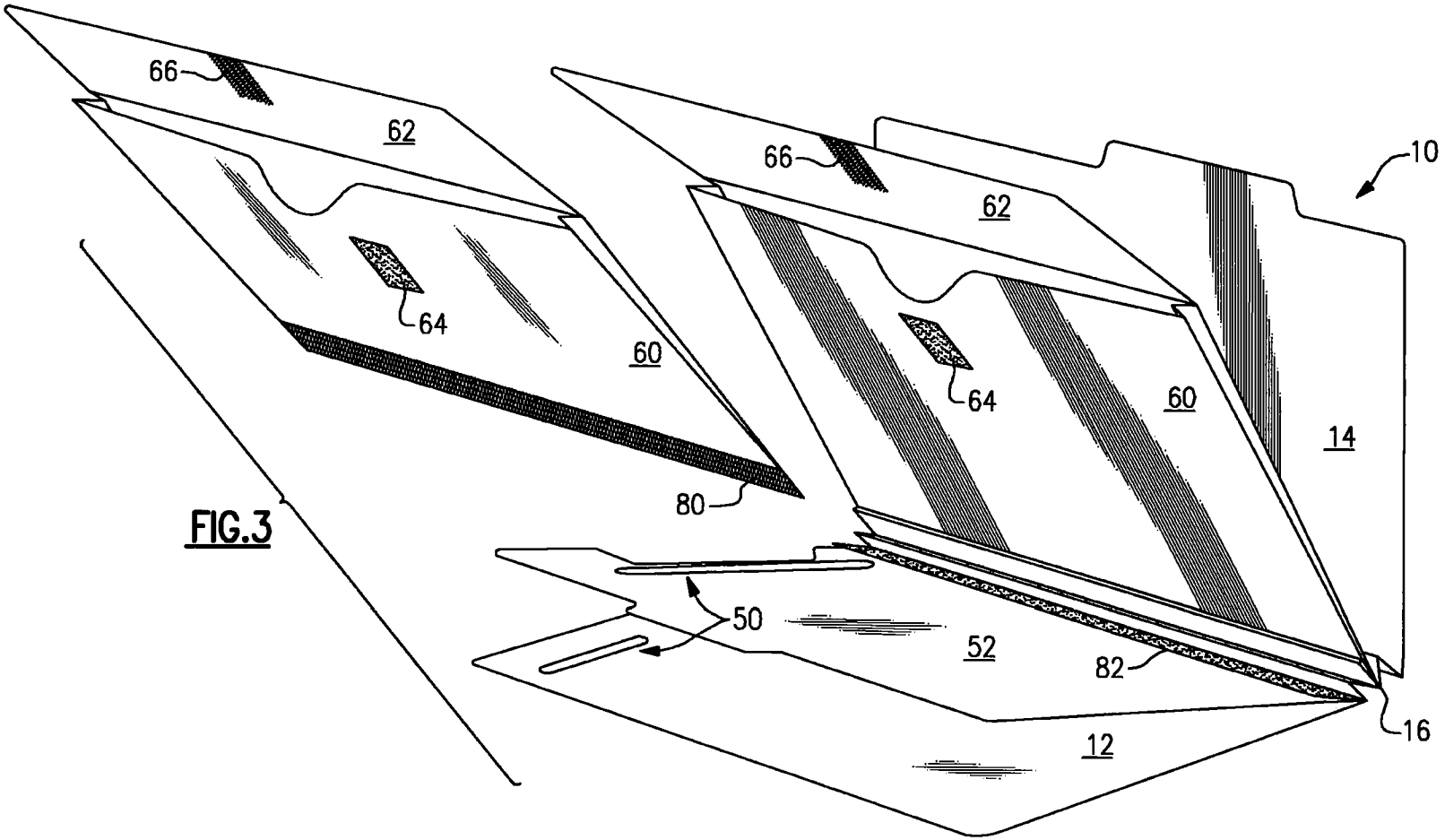
FIG. 3 is a view like FIG. 1 showing an alternate embodiment with a user-replaceable/swappable system and FIG. 4. is a view like FIG. 3, showing a further alternate embodiment.

FIG. 3 differs from FIG. 4 in that the stub element 82 is actually the back side of insert element 52. In this construction, the "stub" is actually a part of an adjacent insert element so that they may be "piggy backed" so the term stub is intended to be interpreted broadly to include any form of attachment which extends from the spine and permits further insert elements to be attached.

Though only wallets (pockets) and dividers with clasps are shown, it will be appreciated that many other types of installable elements may be combined at manufacture, such as jackets, folder pockets, slash jackets, etc., and, with the stub system above, elements can be interchangeably installed by the user.

It will be appreciated that this disclosure is not intended to be limiting of the invention but only as supporting explanation for the claims which define the invention.

The invention claimed is:

1. A file folder, comprising:

a) a first panel having a common edge and an inner facing wall;

b) a second panel having a common edge and a inner facing wall;

c) a first exterior web having a plurality of adjacent accordion peaks and valleys joining said panels proximate said common edge, to create a spine between said panels;

d) at least one insert panel having a common edge and two sides, said insert element being affixed at said common edge to said spine at least one of said valleys;

e) a second interior flexible web extending from and affixed to said one side of said insert panel and overlying said exterior web and all peaks and valleys between said insert panel and an inner facing wall of an adjacent panel f) a third interior flexible web extending from and affixed to the other side of said insert element and then overlying said exterior web and any peaks and valleys between said insert panel and the adjacent panel whereby said insert panel is securely bonded to said second web and the spine proximate the bottom of said valleys.

2. The file folder of claim 1 further including a second insert panel in located in another valley of said spine, and wherein said second web material is affixed at one end to the first insert panel and at the other end at the second insert panel with the remainder of the web between said ends being affixed to the first web material.

3. The folder of claim 2 further including a second web extending from said first panel to one side of said stub, and a third web extending from a different panel to the other side of said stub element and at least a portion of said first and second webs being in bonded contact with said first web.

4. The folder of claim 2 including a plurality of stub members, and wherein said insert panels include a plurality of insert member styles whereby the user may define a folder with different combinations of styles by inserting panels of user's choice.

5. The folder of claim 4 wherein the insert panels include pockets and boards.

6. The folder of claim 4 wherein the insert panels are selected from a group consisting of binders, folios, clip boards, pockets.

7. The folder of claim 2 wherein said adhesion region includes releasable and re-usable adhesive, so that the user may swap insert panels at will.

8. The folder of claim 2 wherein said insert panel includes a plurality of user selectable elements from the group of at least planar elements, pocket elements.

9. The folder of claim 1 wherein said at least one insert element is a stub element of dimension smaller than said first or second panels.

10. A file folder, comprising:

a) a first panel having a common edge;

b) a second panel having a common edge;

c) a first exterior web having a plurality of adjacent accordion peaks and valleys joining said panels proximate said common edge, to create a spine between said panels;

d) at least one insert element having a common edge and two sides, said insert element being affixed at said common edge to said spine at least one of said valleys;

e) a second interior flexible web extending from and affixed to said one side of said insert element and then to at least a portion of said first web along at least one valley wall, f) a third interior flexible web extending from and affixed to the other side of said insert element and then to at least a portion of said first web along at least one valley wall, whereby said insert element is securely bonded to said second web and the spine proximate the bottom of one of said valleys;

g) a second insert panel in located in another valley of said spine, and wherein said second web material is affixed at one end to the first insert panel and at the other end at the second insert panel, with the remainder of the web between said ends being affixed to the first web material and;

wherein said adhesion region includes releasable and re-usable adhesive, so that the user may swap insert panels at will.

* * * * *